US007346961B2

(12) United States Patent
Miwa et al.

(10) Patent No.: US 7,346,961 B2
(45) Date of Patent: Mar. 25, 2008

(54) FIBER HAVING INCREASED FILAMENT SEPARATION AND METHOD OF MAKING SAME

(75) Inventors: Kishio Miwa, Madison, AL (US); Eric William Winters, Decatur, AL (US)

(73) Assignee: Toray Fluorofibers (America), Inc., Decatur, AL (US)

( * ) Notice: Subject to any disclaimer, the term of this patent is extended or adjusted under 35 U.S.C. 154(b) by 454 days.

(21) Appl. No.: 10/935,982

(22) Filed: Sep. 8, 2004

(65) Prior Publication Data

US 2006/0051574 A1 Mar. 9, 2006

(51) Int. Cl.
*D01G 1/00* (2006.01)

(52) U.S. Cl. ..... 19/3

(58) Field of Classification Search ..... 19/3–64
See application file for complete search history.

(56) References Cited

U.S. PATENT DOCUMENTS

| | | | | |
|---|---|---|---|---|
| 3,109,699 | A | 11/1963 | Richardson | |
| 3,271,493 | A | 9/1966 | Berge | |
| 3,921,874 | A | 11/1975 | Spain | |
| 3,990,976 | A | 11/1976 | Nishioka | |
| 4,483,488 | A * | 11/1984 | Luff et al. | 241/19 |
| 5,197,678 | A * | 3/1993 | Trezek et al. | 241/21 |
| 6,247,389 | B1 | 6/2001 | Samuels et al. | |
| 6,436,323 | B1 | 8/2002 | North et al. | |
| 6,730,398 | B2 * | 5/2004 | Morita et al. | 428/367 |
| 2004/0258606 | A1 * | 12/2004 | Yamamoto et al. | 423/447.2 |

* cited by examiner

*Primary Examiner*—Shaun R. Hurley
(74) *Attorney, Agent, or Firm*—C. Brandon Browning; Sirote & Permutt, P.C.

(57) ABSTRACT

A flock material exhibiting an increased degree of filament separation prepared by cutting a fluoropolymer or carbon fiber yarn into lengths, introducing mechanical energy into the lengths in order to cause the lengths to separate into single-filaments fibers and removing or classifying at least a portion of the single-filament fibers from the lengths in order to obtain a flock having a particular fraction of single-filament, fluoropolymer or carbon fibers.

54 Claims, 6 Drawing Sheets

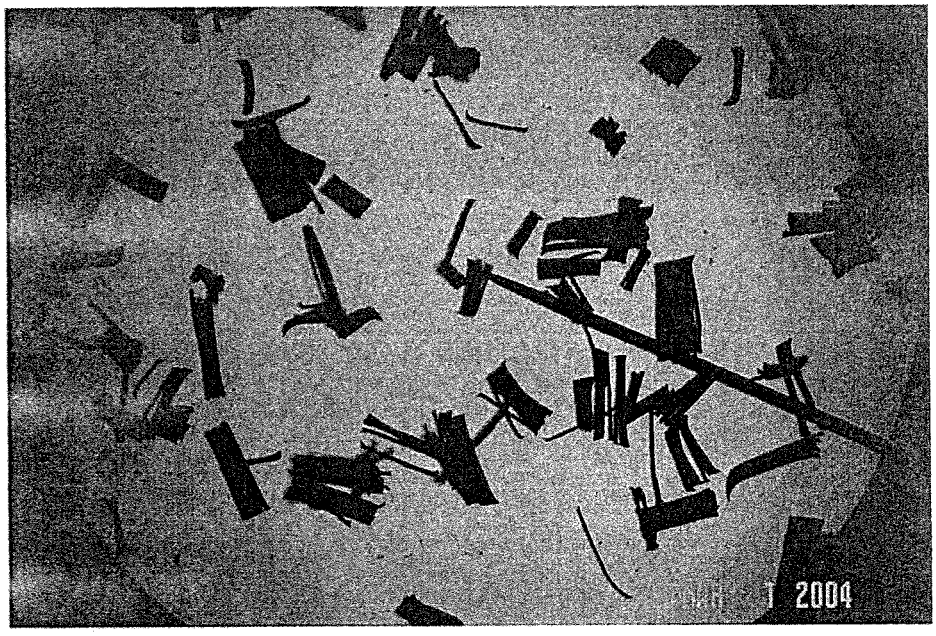
FIG. 1 - - Prior Art - -
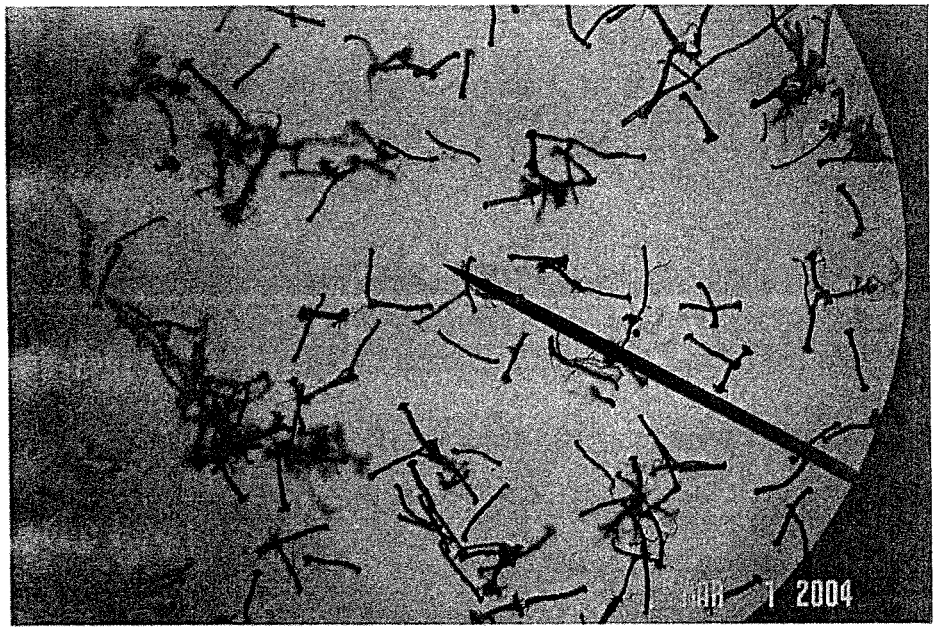
FIG. 2

FIBER HAVING INCREASED FILAMENT SEPARATION AND METHOD OF MAKING SAME

FIELD OF INVENTION

The present invention relates to a novel fiber and a method for preparation therefore. More particularly, the present invention relates to a flock or staple prepared from a multifilament fiber, the flock or staple having improved filament separation.

BACKGROUND OF INVENTION

Flock is a very short or pulverized fiber that can be used to, among other things, form a velvety pattern on cloth or paper, or a covering on metal or plastic. Flock is made from any number of known fibers including natural fibers, such as cotton and wool, as well as from wet or melt spun fibers, such as fluorocarbon polymer ("fluoropolymer") fiber and carbon fiber. Fluoropolymer fiber flock is used as a friction modifier in many different end uses including electrical components, chemical processing equipment and in coatings for cooking utensils, bushings, bearings, pipes and gaskets. When used as a friction modifier in industrial applications, such as bearings, fluoropolymer fiber flock is typically prepared from a continuous fluoropolymer filament yarn chopped into very short flock; this flock is then mixed with a resin and molded into articles or parts. Carbon fiber flock, on the other is hand, is generally used to reinforce materials like epoxy resins and other thermosetting materials. Carbon fiber reinforced composites are very strong for their weight and are often stronger than steel but lighter. When used in these applications, carbon fiber is typically prepared by melt-spinning or solution spinning to produce a precursor fiber which is extruded through a multi-hole spinneret resulting in a multifilament carbon fiber yarn. The yarn is then cut into very short flock and can be mixed with an epoxy resin or made into carbon fiber paper. Carbon fiber reinforced composites can be used to replace metals in many uses, from parts for airplanes and the space shuttle to tennis rackets and golf clubs.

When flock is derived from fluoropolymer yarn or carbon fiber yarn, as described above, it is well known that the individual filaments of the flock tend to stick together forming multifilament bundles of flock fibers, rather than individual flock fibers. With regard to fluoropolymer fibers, sticking typically occurs between adjacent filaments and is caused by sintering the fibers, which results in the fluoropolymer particles in adjacent filaments binding together. As a result, when used in different applications, the full benefits of including the flock are not realized, since the flock does not distribute evenly across or through an article and since the multifilament bundles do not present their full potential surface area on or within the article. However, by dispersing a portion the multifilament bundles of a flock into single-filament fibers, the flock can be more evenly distributed across or through an article, which has the effect of increasing the surface area of the flock over the surface area of the multifilament bundles. This way, the benefits derivable from flock are improved.

OBJECTS AND SUMMARY OF THE INVENTION

A primary object of the invention is to provide a fluoropolymer or carbon fiber flock or staple having an altered physical structure and a method for preparation therefore.

A further primary object of the present invention is to provide a fluoropolymer or carbon fiber flock or staple having an increased degree of filament separation and a method for preparation therefore.

A further primary object of the present invention is to provide a fluoropolymer or carbon fiber flock or staple having frayed ends and a method for preparation therefore.

A further primary object of the present invention is to provide a frayed fluoropolymer or carbon fiber flock or staple and a method for preparation therefore.

A further primary object of the present invention is to provide a wavy fluoropolymer or carbon fiber flock or staple and a method for preparation therefore.

A further primary object of the present invention is to provide a fluoropolymer or carbon fiber flock or staple prepared from a yarn, the flock or staple exhibiting improved filament separation.

A further primary object of the present invention is to provide a fluoropolymer flock or staple prepared from continuous PTFE filament yarn, the flock or staple having an increased degree of filament separation and/or surface area.

A further primary object of the present invention is to provide a fluoropolymer or carbon fiber flock or staple prepared from lengths of yarn processed with an air classification mill.

A further primary object of the present invention is to provide a fluoropolymer or carbon fiber flock or staple having improved filament separation provided by a process that does not substantially damage the flock or staple.

A further primary object of the present invention is to provide a metallic, plastic or rubber part including a fluoropolymer or carbon fiber flock or staple, the flock or staple having a physical structure altered by processing with an air classification mill.

A further primary object of the present invention is to provide a bearing, bushing, fabric, belt, diaphragm, coating, filter or seal including a fluoropolymer flock or staple, the flock or staple having a physical structure altered by processing with an air classification mill.

A further primary object of the present invention is to provide a method for altering the physical structure of flock or staple that is prepared from lengths of a fluoropolymer or carbon fiber yarn.

A further primary object of the invention is to provide a method for overcoming binding of adjacent filaments of a multifilament wet spun fiber caused by sintering the fiber by processing the multifilament fiber in an air classification mill.

A further primary object of the invention is to provide a fluoropolymer fiber flock prepared from a cellulosic ether-based matrix and having a filament separation greater than 65% by weight.

A further primary object of the invention is to provide a fluoropolymer fiber flock prepared from viscose and having a filament separation greater than 80% by weight.

Another object of the invention is to increase the surface area of an amount of flock or staple.

Yet another object of the invention is to increase the anchoring strength of flock or staple within a part.

The various objects of the present invention are accomplished by providing a yarn including a fluoropolymer fiber, such as continuous polytetrafluoroethylene ("PTFE"), or a carbon fiber, cutting the yarn into multifilament pieces having a predetermined length(s), such as is typical for flock or staple, introducing mechanical energy into the pieces thereby converting a portion of the multifilament pieces into single-filament pieces and removing or classifying at least a portion of the single-filament pieces from the multifilament pieces in order to obtain a product including a particular fraction of the single-filament fluoropolymer or carbon fiber pieces. Preferably, the process of filament separation and classification is accomplished by introducing a stream of the multifilament pieces into an air stream, introducing mechanical energy into the multifilament pieces in order to separate the multifilament pieces into single-filament pieces and relying on the terminal velocity of the pieces to segregate those pieces having different weights, i.e., multifilament pieces from single-filament pieces. A separation and classification apparatus employable in the present invention preferably can include a rotatable dispersion disk(s) for initially breaking up the multifilament pieces into single-filament pieces and a classifying means, such as a rotor, for imparting a centrifugal force to the multifilament and single-filament pieces. Although such an apparatus is typically used to pulverize or break-down a material, when used in accordance with the present invention, such an apparatus can now be used to separate and classify fluoropolymer or carbon fiber flock or staple without damaging the structure of the individual filaments of the flock or staple fibers, as would be expected. Thus, milling a flock or staple pursuant to the present invention can result in a flock or staple having an increased filament separation with the individual filaments retaining a substantially straight, rod-like arrangement and without exhibiting a substantial amount of fraying or breaking.

When the processed fluoropolymer or carbon fiber of the present invention is mixed with a resin and molded into a part, the properties imparted to the part by including the fiber are enhanced or improved over the properties imparted by the prior art or unprocessed fiber, including for example, when the fiber is a fluoropolymer fiber, increasing the resistance of the part to chemicals, oxidation, moisture, weathering, ozone or ultraviolet radiation and decreasing the amount of energy required to slide the part along an object. Thus, the processed fluoropolymer fiber can be used to impart these improved properties in electrical components, chemical processing equipment and in coatings for cooking utensils, pipes, bearings, bushings, fabrics, filters and gaskets. Specific applications are described, for example, in U.S. Pat. Nos. 6,695,734 (rubber belts); 6,506,491 (friction applications such as bearings, bushings and seals); 6,299,939 (diaphragms for use in an electrolytic cells); 6,180,574 (self-lubricating bearings and coatings) and 5,527,569 (filter media for forming filter cloth, filter bags and filter cartridges). With regard to carbon fiber, the processed carbon fiber can be used, for example, to make electrodes for fuel cells and carbon paper and for reinforcing composites.

Other features, objects and advantages of the present invention will become apparent from a reading of the following description, as well as a study of the appended drawings.

BRIEF DESCRIPTION OF THE DRAWINGS

FIG. 1 is a photomicrograph of a prior art PTFE flock material that has not undergone a filament separation or classification process according to the present invention.

FIG. 2 is a photomicrograph of a PTFE flock material according to the presently preferred embodiment of the present invention, as prepared in Example 1.

DETAILED DESCRIPTION OF THE INVENTION

Figure 3:
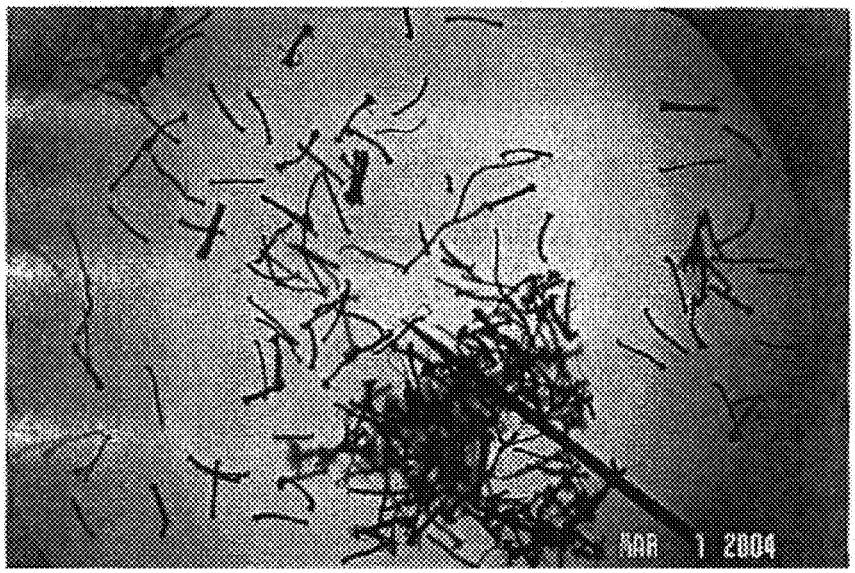
FIG. 3 is a photomicrograph of a PTFE flock material according to the presently preferred embodiment of the present invention, as prepared in Example 2.

The fluoropolymer fiber of the present invention is prepared from a continuous fluoropolymer filament yarn which is made into flock and processed in an air classification mill. The air classification mill disperses and classifies the fluoropolymer fiber flock producing a flock exhibiting new and improved physical properties. Specifically, the air classification milled fluoropolymer flock exhibits a proportionately greater amount of surface area than conventional or unmilled flock, which is precipitated by increasing the degree of filament separation of the fluoropolymer flock fibers, fraying the ends of the fluoropolymer flock fiber and/or fraying the fluoropolymer flock fiber as a whole.

In the present invention, by "fluoropolymer fiber" it is meant a fiber prepared from polymers such as PTFE, and polymers generally known as fluorinated olefinic polymers, for example, copolymers of tetrafluoroethylene and hexafluoropropene, copolymers of tetrafluoroethylene and perfluoroalkyl-vinyl esters such as perfluoropropyl-vinyl ether and perfluoroethyl-vinyl ether, fluorinated olefinic terpolymers including those of the above-listed monomers and other tetrafluoroethylene based copolymers. For the purposes of this invention, the preferred fluoropolymer fiber is PTFE fiber.

The fluoropolymer fiber can be spun by a variety of means, depending on the exact fluoropolymer composition desired. Thus, the fibers can be spun by dispersion spinning; that is, a dispersion of insoluble fluoropolymer particles is mixed with a solution of a soluble matrix polymer and this mixture is then coagulated into filaments by extruding the mixture into a coagulation solution in which the matrix polymer becomes insoluble. The insoluble matrix material may later be sintered and removed if desired. One method which is commonly used to spin PTFE and related polymers includes spinning the polymer from a mixture of an aqueous dispersion of the polymer particles and viscose, where cellulose xanthate is the soluble form of the matrix polymer, as taught for example in U.S. Pat. Nos. 3,655,853; 3,114,672 and 2,772,444. However, the use of viscose suffers from some serious disadvantages. For example, when the fluoropolymer particle and viscose mixture is extruded into a coagulation solution for making the matrix polymer insoluble, the acidic coagulation solution converts the xanthate into unstable xantheic acid groups, which spontaneously lose $CS_2$, an extremely toxic and volatile compound. Preferably, the fluoropolymer fiber of the present invention is prepared using a more environmentally friendly method than those methods utilizing viscose. One such method is described in U.S. Pat. Nos. 5,820,984; 5,762,846, and 5,723,081, which patents are incorporated herein in their entireties by reference. In general, this method employs a cellulosic ether polymer such as methylcellulose, hydroxyethylcellulose, methylhydroxypropylcellulose, hydroxypropylmethylcellulose, hydroxypropylcellulose, ethylcellulose or carboxymethylcellulose as the soluble matrix polymer, in place of viscose. Alternatively, if melt viscosities are amenable, filament may also be spun directly from a melt. Fibers may also be produced by mixing fine powdered fluoropolymer with an extrusion aid, forming this mixture into a billet and extruding the mixture through a die to produce fibers which may have either expanded or un-expanded structures. For the purposes of this invention, the preferred method of making the fluoropolymer fiber is by dispersion is spinning where the matrix polymer is a cellulosic ether polymer.

The fluoropolymer fiber can be made into flock using any number of means known in the art. Preferably, the fluoropolymer fiber is cut into flock by a guillotine cutter, which is characterized by a to-and-fro movement of a cutting blade. The flock preferably has a length of between 150 micrometers and 350 micrometers.

When flock is prepared from a fluoropolymer fiber utilizing a cellulosic ether polymer, the flock exhibits a filament separation of no more than 65% by weight of the flock. Alternatively, when flock is prepared from a fluoropolymer fiber utilizing viscose, the flock exhibits a filament separation of no more than 80% by weight of the flock. Through the present process of separation and classification, the filament separation of the flock can now be increased incrementally up from its initial, unprocessed value of less than 65% or 80% by weight of the flock, depending on the type of soluble matrix polymer used, to 100% by weight of the flock.

The process of separation and classification of the present invention can be achieved by dispersing a portion of the fluoropolymer flock fiber into individual flock filaments, i.e., single-filament flock particles, with a dispersion disk(s) and applying a current of air created by a rotor to the dispersed fluoropolymer flock fiber, whereby the individual flock filaments and a portion of the multifilament flock fibers are removed from the stream by the air current as product. This process is preferably carried out by an air classification mill, examples of which are described in U.S. Pat. Nos. 2,188,634; 2,542,095; 2,796,173; 3,720,313; 4,066,535; 4,100,061; 4,066,535; 4,388,183; 4,560,471; 4,604,192; 4,759,943; 4,869,786; 5,024,754; 5,301,812; 5,366,095; 5,377,843; 5,620,145; 5,622,321; 5,667,149; 6,109,448; 6,202,854; 6,220,446; 6,269,955; 6,276,534; 6,318,561; 6,443,376 and 6,631,808, which patents are incorporated herein in their entireties by reference.

Some of the above-mentioned references disclose air classification mills wherein the current of air directs the milled fine particles inwardly towards the center of a classification chamber. Others of these references disclose designs wherein the current of air directs the milled fine particles to an outer portion of the classifying chamber. Many of these air classification mills exploit the effects of gravity in that upon classification of the fine particles, the fine particles fraction and a course fraction are directed to separate discharge ports located in the bottom portion of a classifier housing. While in others, the fine particles are lifted upwardly against the force of gravity and discharged from an upper portion of the air classification mill. A number of these references disclose air classification mills wherein the dispersion means and the classifying means are separately drivable in order to achieve optimum particle dispersion and classification.

For the purposes of this invention, the preferred air classification mill is an air classification mill including separately drivable dispersion means and classifying means, where the individual flock filaments are lifted upwardly against the force of gravity and discharged from an upper central portion of the mill. More particularly, the preferred air classification mill is an air purged classification mill ("APCM") including separately drivable dispersion means comprising a single rotatable disk supporting four pins and classifying means comprising twenty-four substantially vertical blades rotatable about a central axis, where the individual flock filaments are lifted upwardly against the force of gravity and discharged from an upper, central portion of the APCM.

By varying the speed of rotation of the dispersion means and classifying means, as well as varying the flow rate of air through the APCM, it has now been discovered that the degree of filament separation of a fluoropolymer flock fiber fed into the APCM can be incrementally increased from its original filament separation value of no more than 65% by weight for cellulosic ether-based fibers and no more than 80% by weight for viscose-based fibers, up to 100% by weight without substantially damaging the individual filaments of the flock. In other words, by incrementally increasing the amount of mechanical energy introduced into the flock, the degree of filament separation of the flock fibers is incrementally increased without affecting the generally straight, rod-like structure of the individual filaments, as would be expected from milling a material in an air classification mill. However, by introducing excess mechanical energy into the fluoropolymer flock fiber, the structure of the individual filaments of the flock can be effected to include increased fraying or to impart a bend therein. Thus, by simply varying the working parameters of the APCM, namely classifying means rotation speed, dispersion means rotation speed and air flow rate, the degree of filament separation of a fluoropolymer flock can be increased and if desired, the structure of the filaments frayed, curved and/or broken.

It is well-known that more energy is required to separate the filaments of fluoropolymer flock fibers prepared from a yarn than the filaments of carbon flock fibers prepared from a yarn. Accordingly, the amount of mechanical energy required to provide a degree of filament separation for carbon flock fibers will be less than the amount of mechanical energy required to provide the same degree of filament separation for PTFE flock fibers.

PREFERRED EMBODIMENTS OF THE INVENTION

The present invention will be explained further in detail by the following Examples. In each of the Examples, a 6.7 denier per filament continuous, cellulosic ether-based PTFE filament yarn was prepared and cut with a guillotine cutter into flock and the filament separation of the flock calculated. Filament separation was determined by preparing and evaluating three samples of the flock and determining the average filament separation value, i.e., the percentage by weight of the flock that is present as single-filament flock particles.

More particularly, a sample was prepared from the flock by (1) providing a wooden dowel having a diameter between 0.125 inches and 0.25 inches, (2) dipping the dowel into the flock and rotating the dowel in order to cause a portion of the flock to adhere to the dowel, (3) holding the dowel over a microscope slide and tapping the dowel such that the adhered flock falls onto the slide and distributes across at least 50% of the surface of the slide, and (4) repeating steps 1 through 3 to provide a total a three slide preparations. Thereafter, the slide preparations were evaluated by (1) observing a slide preparation utilizing a microscope under 40× magnification, (2) counting the total number filaments in the field of view, including all single-filaments and all individual filaments making up the multifilaments, (3) counting the total number of single-filaments, (4) dividing the number of single-filaments by the total number of filaments and multiplying the quotient by 100 to provide the percentage of single-filaments, (5) repeating steps 1 through 4 for the remaining two slide preparations, and (6) adding together the percentages of single-filaments for each one of the three slide preparations and dividing the result by 3 to provide the percentage of filament separation of the flock.

After the filament separation was determined, the flock was loaded into a hopper and the temperature of the room was measured and recorded. Utilizing a screw-type feeder, the flock was fed from the hopper through a feed line into a 10 HP APCM having a separately drivable four pin dispersion disk and 3 HP, twenty-four blade classifier. A fan of a cyclone separator located downstream of the APCM and connected therewith by a conduit was used to draw the milled flock out of an upper portion of the APCM, through the conduit and into the cyclone separator. The pressure differential generated by the fan between the fan and the APCM was measured and recorded. The milled flock was collected from the cyclone separator and examined.

EXAMPLE 1

The dispersion disk and classifier were set to rotate at 6,000 rpm and 2,800 rpm, respectively. The temperature of the room was 60° F. The pressure differential generated by the fan between the fan and the APCM was 15 atm, i.e., −7 atm in the APCM and −22 atm at the fan. As depicted in FIG. 2, the milled flock exhibited an increased degree of filament separation over the un-milled flock depicted in FIG. 1. However, the flock included many fibrils giving the flock fibers a frayed or torn appearance. Additionally, a number of the fibers exhibited frayed ends giving the fibrils a bulbous or pom-pom shaped ends.

EXAMPLE 2

The dispersion disk and classifier were set to rotate at 6,000 rpm and 2,500 rpm, respectively. The temperature of the room was 60° F. The pressure differential generated by the fan between the fan and the APCM was 15 atm, i.e., −7 atm in the APCM and −22 atm at the fan. As depicted in FIG. 3, the milled flock exhibited an increased degree of filament separation over the un-milled flock depicted in FIG. 1. Like in Example 1, the milled flock included many fibrils, and many of the flock fibers were torn or frayed, giving the fibers a fuzzy appearance and pom-pom shaped ends.

EXAMPLE 3

Figure 4:
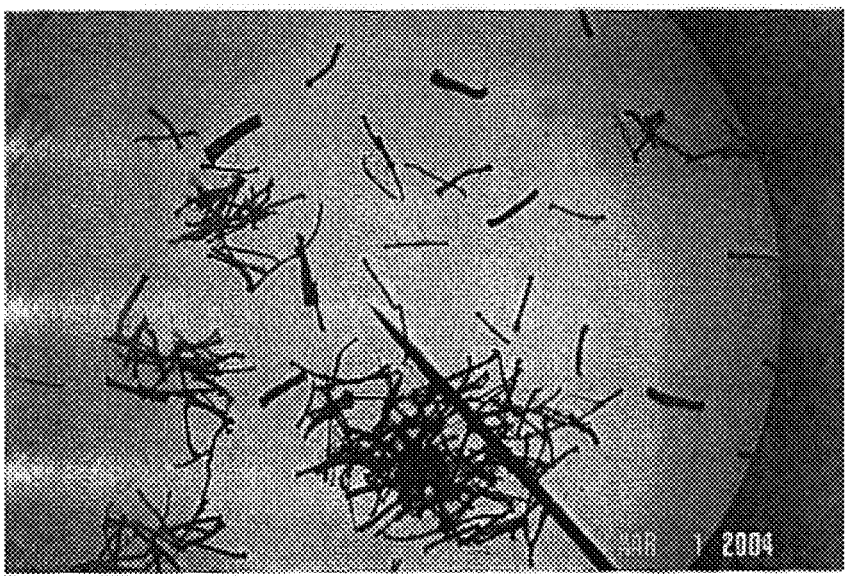
FIG. 4 is a photomicrograph of a PTFE flock material according to the presently preferred embodiment of the present invention, as prepared in Example 3.

The dispersion disk and classifier were set to rotate at 5,000 rpm and 2,000 rpm, respectively. The temperature of the room was 60° F. The pressure differential generated by the fan between the fan and the APCM was 15 atm, i.e., −7 atm in the APCM and −22 atm at the fan. As depicted in FIG. 4, the milled flock exhibited an increased degree of filament separation over the un-milled flock depicted in FIG. 1 but not as much separation as found in Examples 1 and 2. Thus multifilament pieces were seen, primarily double filament pieces. Though some fibrils were apparent, as some of the fibers were torn or frayed, less were torn or frayed than were seen in Examples 1 and 2.

EXAMPLE 4

Figure 5:
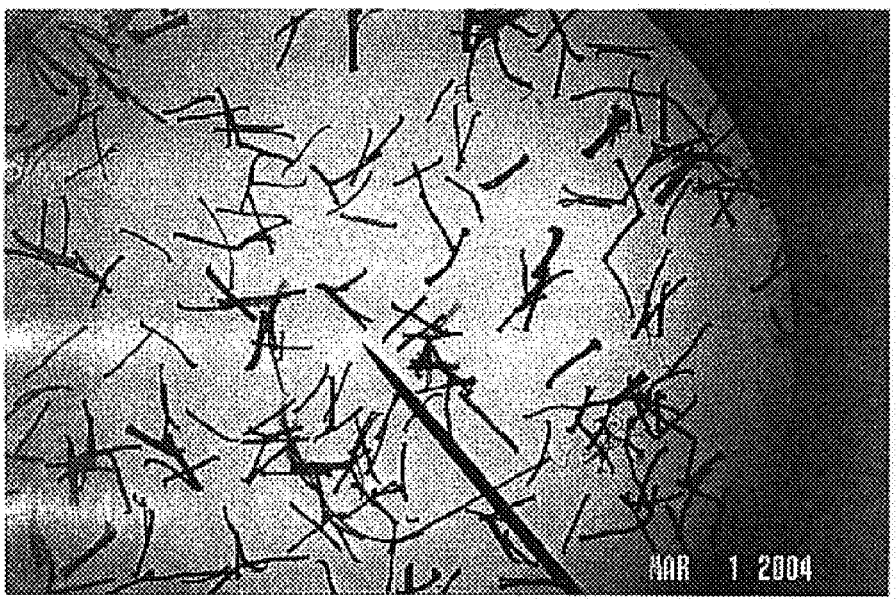
FIG. 5 is a photomicrograph of a PTFE flock material according to the presently preferred embodiment of the present invention, as prepared in Example 4.

The dispersion disk and classifier were set to rotate at 5,500 rpm and 2,300 rpm, respectively. The temperature of the room was 60° F. The pressure differential generated by the fan between the fan and the APCM was 15 atm, i.e., −7 atm in the APCM and −22 atm at the fan. As depicted in FIG. 5, the milled flock exhibited an increased degree of filament separation over the un-milled flock depicted in FIG. 1, similar to the degree of separation found in Examples 1 and 2. Thus, the flock of Example 4 exhibited less multifilament pieces than Example 3, but it also exhibited less fraying than Examples 1 and 2.

EXAMPLE 5

Figure 6:
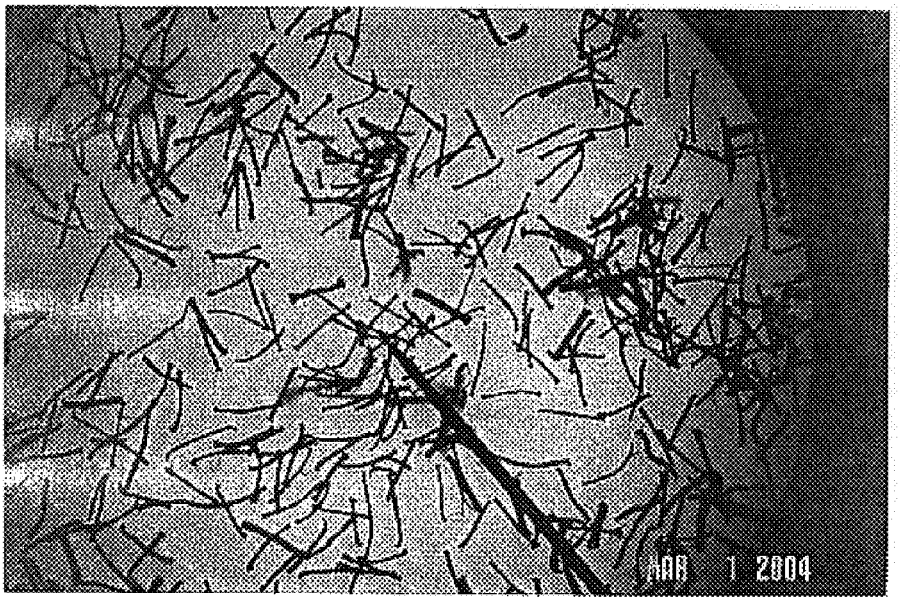
FIG. 6 is a photomicrograph of a PTFE flock material according to the presently preferred embodiment of the present invention, as prepared in Example 5.

The dispersion disk and classifier were set to rotate at 2,500 rpm and 1,200 rpm, respectively. The temperature of the room was 56° F. The pressure differential generated by the fan between the fan and the APCM was 15 atm, i.e., −7 atm in the APCM and −22 atm at the fan. As depicted in FIG. 6, the milled flock exhibited an increased degree of filament separation over the un-milled flock depicted in FIG. 1, similar to the degree of separation found in Example 4. Similar again to Example 4, the flock exhibited less multifilament pieces than Example 3 and less fraying than Examples 1 and 2.

EXAMPLE 6

Figure 7:
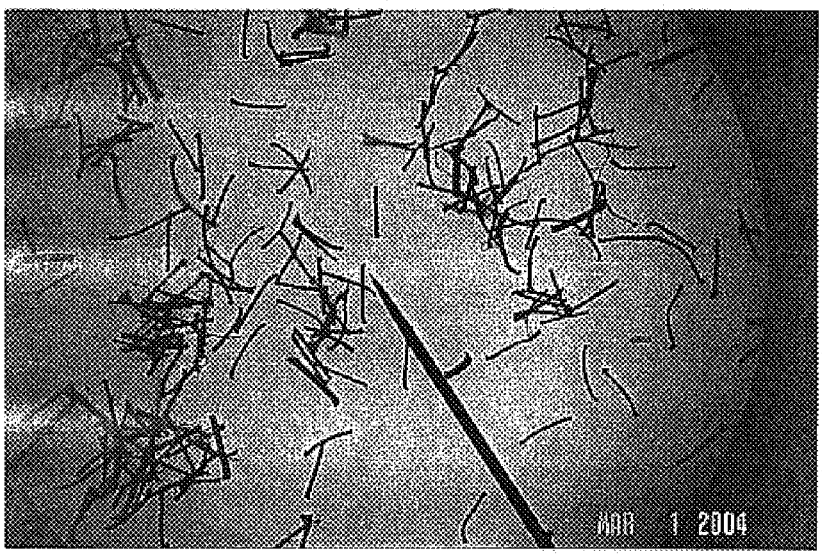
FIG. 7 is a photomicrograph of a PTFE flock material according to the presently preferred embodiment of the present invention, as prepared in Example 6.

The dispersion disk and classifier were set to rotate at 2,500 rpm and 1,200 rpm, respectively. The temperature of the room was 59° F. The pressure differential generated by the fan between the fan and the APCM was 12 atm, i.e., −7 atm in the APCM and −19 atm at the fan. As depicted in FIG. 7, the milled flock exhibited an increased degree of filament separation over the un-milled flock depicted in FIG. 1 and looked essentially identical to Example 5. The milled flock included less fibrils than in Example 4.

EXAMPLE 7

Figure 8:
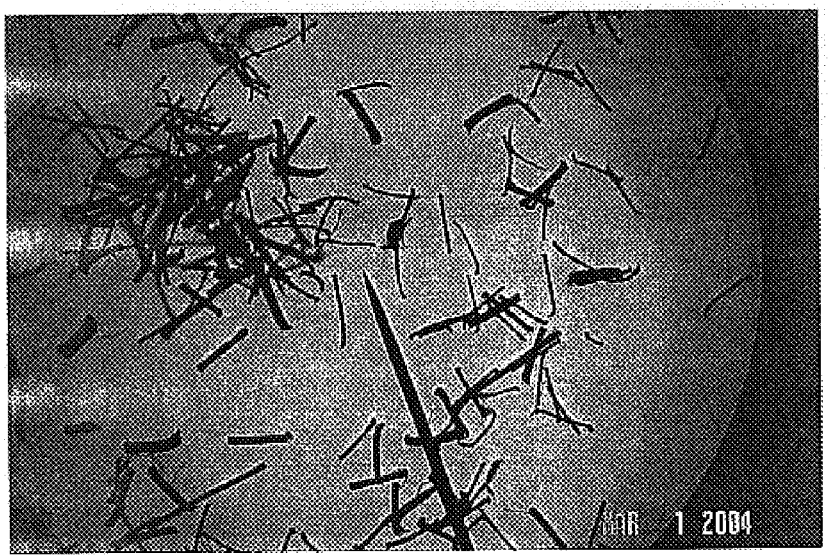
FIG. 8 is a photomicrograph of a PTFE flock material according to the presently preferred embodiment of the present invention, as prepared in Example 7.

The dispersion disk and classifier were set to rotate at 2,500 rpm and 800 rpm, respectively. The temperature of the room was 40° F. The pressure differential generated by the fan between the fan and the APCM was 12 atm, i.e., −7 atm in the APCM and −19 atm at the fan. As depicted in FIG. 8, the milled flock exhibited an increased degree of filament separation over the un-milled flock depicted in FIG. 1; however, the flock exhibited more multifilament pieces, including doubles, triples and quadruples, than in any of Examples 1 through 6.

EXAMPLE 8

Figure 9:
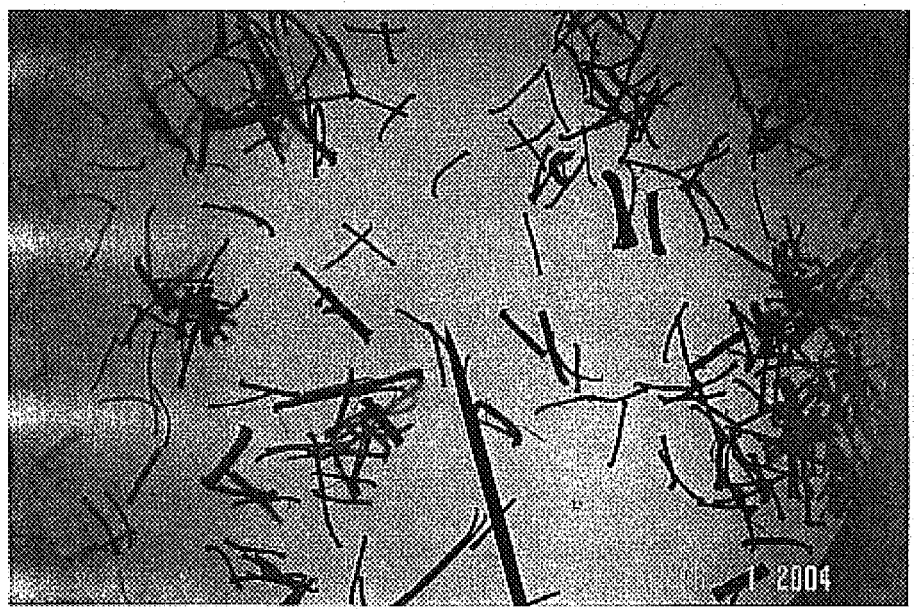
FIG. 9 is a photomicrograph of a PTFE flock material according to the presently preferred embodiment of the present invention, as prepared in Example 8.

The dispersion disk and classifier were set to rotate at 3,000 rpm and 1,200 rpm, respectively. The temperature of the room was 40° F. The pressure differential generated by the fan between the fan and the APCM was 12 atm, i.e., −9 atm in the APCM and −21 atm at the fan. As depicted in FIG. 9, the milled flock exhibited an increased degree of filament separation over the un-milled flock depicted in FIG. 1. The degree of separation of the milled flock was between that found in Examples 5 and 7.

EXAMPLE 9

Figure 10:
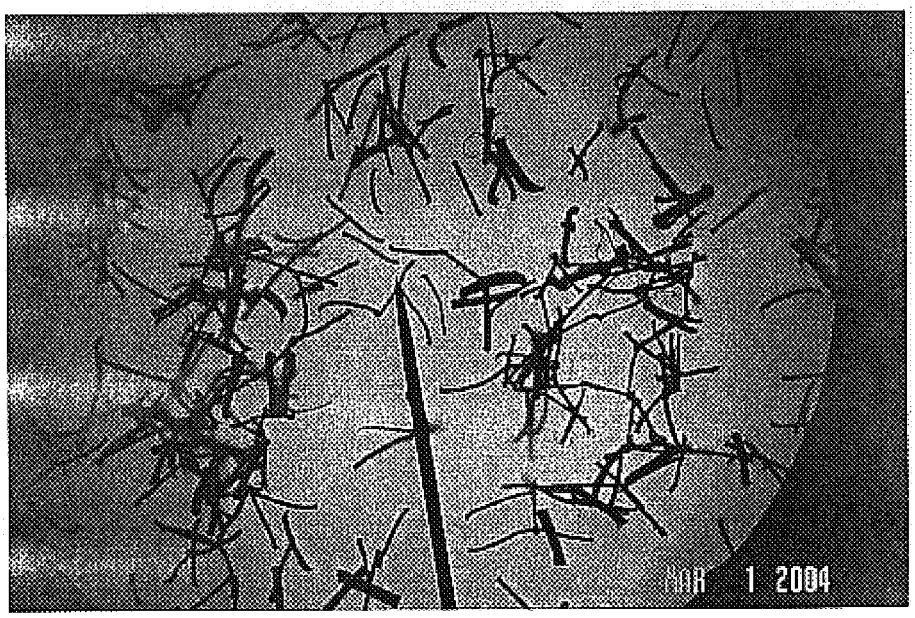
FIG. 10 is a photomicrograph of a PTFE flock material according to the presently preferred embodiment of the present invention, as prepared in Example 9.

The dispersion disk and classifier were set to rotate at 4,000 rpm and 1,000 rpm, respectively. The temperature of the room was 40° F. The pressure differential generated by the fan between the fan and the APCM was 15 atm, i.e., −10 atm in the APCM and −25 atm at the fan. As depicted in FIG. 10, the milled flock exhibited an increased degree of filament separation over the un-milled flock depicted in FIG. 1, similar to the filament separation exhibited in Example 7. Thus the milled flock included several multifilament pieces.

EXAMPLE 10

Figure 11:
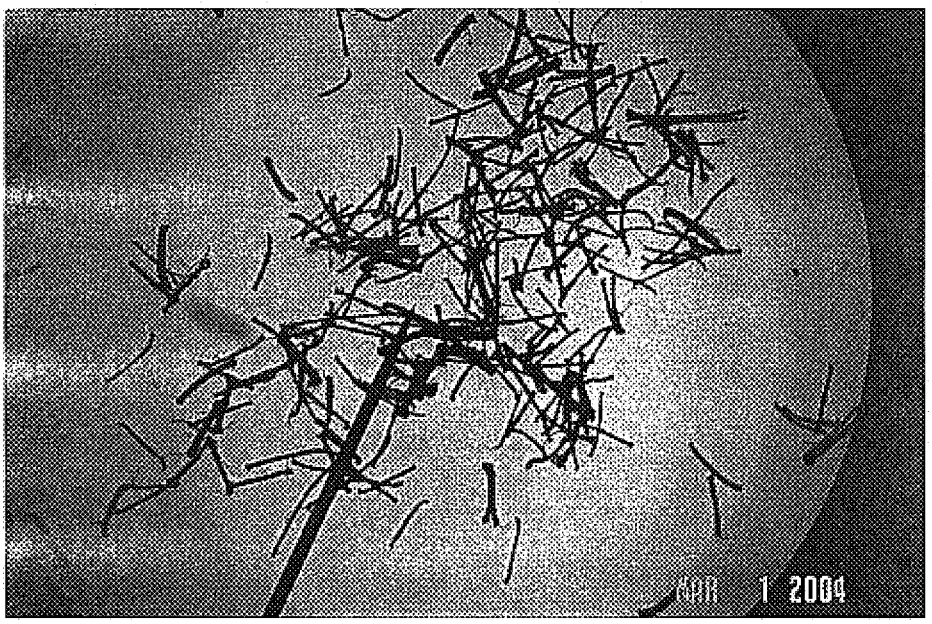
FIG. 11 is a photomicrograph of a PTFE flock material according to the presently preferred embodiment of the present invention, as prepared in Example 10.

The dispersion disk and classifier were set to rotate at 4,000 rpm and 1,200 rpm, respectively. The temperature of the room was 40° F. The pressure differential generated by the fan between the fan and the APCM was 11 atm, i.e., −9 atm in the APCM and −20 atm at the fan. As depicted in FIG. 11, the milled flock exhibited an increased degree of filament separation over the un-milled flock depicted in FIG. 1. The flock included a number of fibrils, as well as, multifilament pieces.

EXAMPLE 11

Figure 12:
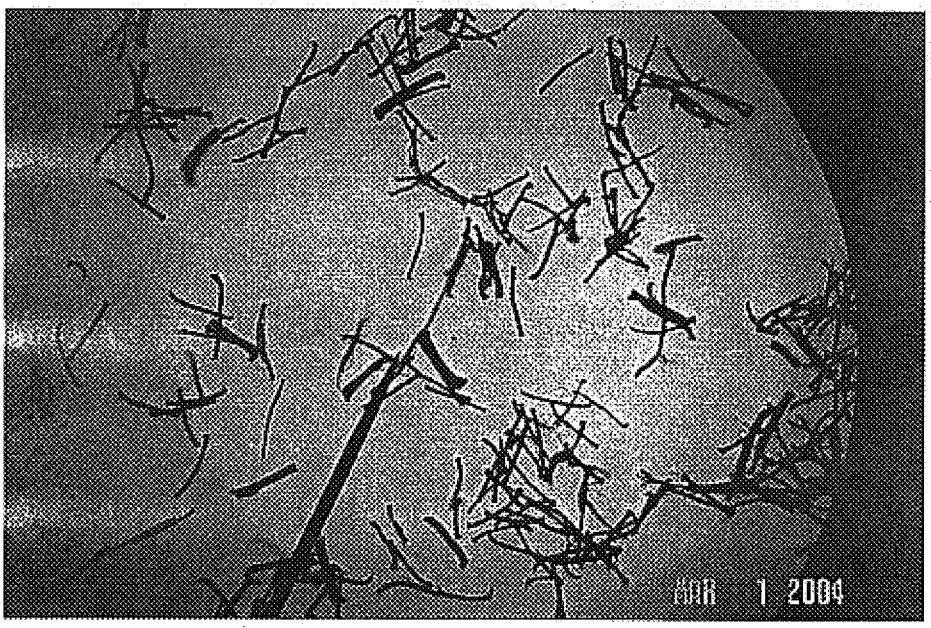
FIG. 12 is a photomicrograph of a PTFE flock material according to the presently preferred embodiment of the present invention, as prepared in Example 11.

The dispersion disk and classifier were set to rotate at 4,000 rpm and 2,000 rpm, respectively. The temperature of the room was 40° F. The pressure differential generated by the fan between the fan and the APCM was 11 atm, i.e., −9 atm in the APCM and −20 atm at the fan. As depicted in FIG. 12, the milled flock exhibited an increased degree of filament separation over the un-milled flock depicted in FIG. 1; however, the flock appeared fuzzy including a number of fibrils. In addition, some of the fibers appeared wavy or split.

In summary, it was observed that by varying the rotation speed of the dispersion disk, the rotation speed of the classifier and, to a lesser degree, the pressure differential created by the fan of the cyclone separator, the physical properties of the flock were selectively altered. Thus it was discovered that by incrementally increasing the amount of mechanical energy introduced into the flock by the APCM, the degree of filament separation of the flock could be incrementally increased up to 100% by weight. It was further discovered that if a sufficient amount of energy was introduced into the flock the ends of the flock could be frayed thereby giving the ends a bulbous appearance. Additionally, as more mechanical energy was introduced into the flock, the flock was further frayed giving the flock a fuzzy appearance. The ultimate result observed by processing the flock with the APCM was that the surface area of the flock could be increased.

As will be apparent to one skilled in the art, various modifications can be made within the scope of the aforesaid description. Such modifications being within the ability of one skilled in the art form a part of the present invention and are embraced by the claims below.

It is claimed:

1. A method of making a flock or staple prepared from a yarn comprising, cutting the yarn into multifilament pieces, the yarn being selected from the group consisting of a fluoropolymer yarn and a carbon fiber yarn, and processing the multifilament pieces with an air classification mill, wherein processing the multifilament pieces with an air classification mill converts a portion of the multifilament pieces into single-filament pieces.

2. The method according to claim 1 wherein processing the multifilament pieces with an air classification mill converts a portion of the multifilament pieces into frayed single-filament pieces.

3. The method according to claim 1 wherein processing the multifilament pieces with an air classification mill converts a portion of the multifilament pieces into curved single-filament pieces.

4. The method according to claim 1 wherein, when the yarn is a fluoropolymer yarn including a cellulosic ether-based matrix, said portion is greater than 65% by weight and less than about 70% by weight.

5. The method according to claim 1 wherein, when the yarn is a fluoropolymer yarn including a cellulosic ether-based matrix, said portion is about 70% by weight up to about 75% by weight.

6. The method according to claim 1 wherein, when the yarn is a fluoropolymer yarn including a cellulosic ether-based matrix, said portion is about 75% by weight up to about 80% by weight.

7. The method according to claim 1 wherein, when the yarn is a fluoropolymer yarn, said portion is greater than 80% by weight and less than about 85% by weight.

8. The method according to claim 1 wherein, when the yarn is a fluoropolymer yarn, said portion is about 85% by weight up to about 90% by weight.

9. The method according to claim 1 wherein, when the yarn is a fluoropolymer yarn, said portion is about 90% by weight up to about 95% by weight.

10. The method according to claim 1 wherein, when the yarn is a fluoropolymer yarn, said portion is about 95% by weight up to about 100% by weight.

11. The method according to claim 1 wherein the portion of multifilament pieces is predetermined by setting at least one of a classifying means or a dispersion means of the air classification mill to a predetermined rotation speed.

12. The method according to claim 1 wherein the yarn is prepared by dispersion spinning.

13. The method according to claim 1 wherein the yarn is not prepared from a sheet.

14. The method according to claim 1 wherein the yarn is not machined by pin rolls.

15. The method according to claim 1 wherein the yarn is a dispersion spun polytetraethylene filament yarn.

16. A method of varying the physical arrangement of a material including at least one of a fluoropolymer fiber or a carbon fiber, the method comprising, processing the material with an air classification mill, wherein processing the material with the air classification mill increases a filament separation of the material.

17. The method according to claim 16 wherein the material is flock.

18. The method according to claim 16 wherein the material is staple.

19. The method according to claim 16 wherein the fluoropolymer fiber is polytetraethylene fiber.

20. The method according to claim 16 wherein the material is prepared from lengths of a multifilament yarn.

21. The method according to claim 20 wherein processing the material with the air classification mill increases a surface area of the material.

22. The method according to claim 16 wherein processing the material with the air classification mill frays a portion of the material.

23. The method according to claim 16 wherein processing the material with the air classification mill imparts a curve to a portion of the material.

24. The method according to claim 17 wherein the flock is prepared from a dispersion spun fiber.

25. The method according to claim 16 wherein, when the material includes a fluoropolymer fiber including a cellulosic ether-based matrix, the filament separation of the material is greater than 65% by weight of the material.

26. The method according to claim 16 wherein, when the material includes a fluoropolymer fiber, the filament separation of the material is greater than 80% by weight of the material.

27. The method according to claim 20 wherein the individual filaments of the lengths of the multifilament yarn retain a substantially straight, rod-like appearance after the processing.

28. The method according to claim 1 wherein the portion is essentially free of damaged filaments.

29. The method according to claim 1 wherein the yarn consists of a 5.5 denier to 7.7 denier fluoropolymer fiber having a diameter of about 15.3 micrometers up to about 21 micrometers.

30. The method according to claim 29 wherein the fluoropolymer fiber is 6.7 denier and 18 micrometers in diameter.

31. The method according to claim 1 further comprising controlling the size of the portion by manipulating one or more of a speed of rotation of a dispersion means of the air classification mill, a speed of rotation of a classifying means of the air classification mill and a flow rate of air through the air classification mill.

32. The method according to claim 16 wherein the amount of the filament separation is predetermined by manipulating one or more of a speed of rotation of a dispersion means of the air classification mill, a speed of rotation of a classifying means of the air classification mill and a flow rate of air through the air classification mill.

33. The method according to claim 16 wherein the material is essentially free of damaged filaments.

34. The method according to claim 16 wherein the material includes 5.5 denier to 7.7 denier fluoropolymer fibers having a diameter of about 15.3 micrometers up to about 21 micrometers.

35. The method according to claim 34 wherein the fluoropolymer fibers are 6.7 denier and 18 micrometers in diameter.

36. A method of varying the physical arrangement of polytetrafluoroethylene multifilament fibers comprising, converting a portion of the multifilament fibers into single filament fibers by processing the multifilament fibers in an air classification mill.

37. The method according to claim 36 wherein more than 80% by weight and less than about 85% by weight of the multifilament fibers are converted into the single filament fibers.

38. The method according to claim 36 wherein more than 85% by weight and less than about 90% by weight of the multifilament fibers are converted into the single filament fibers.

39. The method according to claim 36 wherein more than 90% by weight and less than about 95% by weight of the multifilament fibers are converted into the single filament fibers.

40. The method according to claim 36 wherein more than 95% by weight and less than about 100% by weight of the multifilament fibers are converted into the single filament fibers.

41. The method according to claim 36 wherein the single filament fibers are essentially free of damaged fibers.

42. The method according to claim 36 further comprising controlling the size of the portion by manipulating one or more of a speed of rotation of a dispersion means of the air classification mill, a speed of rotation of a classifying means of the air classification mill and a flow rate of air through the air classification mill.

43. The method according to claim 36 further comprising converting another portion of the multifilament fibers into frayed fibers.

44. The method according to claim 36 further comprising converting another portion of the multifilament fibers into curved fibers.

45. The method according to claim 36 wherein polytetrafluoroethylene multifilament fibers are 5.5 denier to 7.7 denier polytetrafluoroethylene fibers having a diameter of about 15.3 micrometers up to about 21 micrometers.

46. The method according to claim 36 wherein the polytetrafluoroethylene multifilament fibers are 6.7 denier polytetrafluoroethylene fibers having a diameter of about 18 micrometers.

47. The method according to claim 36 wherein the polytetrafluoroethylene multifilament fibers are flock.

48. A method of varying the physical arrangement of flock comprising, providing polytetrafluoroethylene multifilament fiber flock, and converting between 90 percent by weight up to 100 percent by weight of the polytetrafluoroethylene multifilament fiber flock into single filament flock by processing the flock in an air classification mill, wherein the percentage of single filament flock is predetermined and controlled by manipulating one or more of a speed of rotation of a dispersion means of the air classification mill, a speed of rotation of a classifying means of the air classification mill and a flow rate of air through the air classification mill.

49. A method of varying the physical arrangement of flock comprising, providing a fluoropolymer multifilament fiber flock, and converting a predetermined amount of the fluoropolymer multifilament fiber flock into single filament flock by processing the flock in an air classification mill, wherein the predetermined amount is selected by manipulating one or more of a speed of rotation of a dispersion means of the air classification mill, a speed of rotation of a classifying means of the air classification mill and a flow rate of air through the air classification mill.

50. The method according to claim 49 wherein the fluoropolymer multifilament fiber flock is a polytetrafluoroethylene multifilament fiber flock.

51. The method according to claim 49 wherein the predetermined amount is more than 80% by weight and less than 85% by weight.

52. The method according to claim 49 wherein the predetermined amount is more than 85% by weight and less than 90% by weight.

53. The method according to claim 49 wherein the predetermined amount is more than 90% by weight and less than 95% by weight.

54. The method according to claim 49 wherein the predetermined amount is more than 95% by weight.

* * * * *

UNITED STATES PATENT AND TRADEMARK OFFICE

CERTIFICATE OF CORRECTION

PATENT NO. : 7,346,961 B2
APPLICATION NO. : 10/935982
DATED : March 25, 2008
INVENTOR(S) : Kishio Miwa et al.

It is certified that error appears in the above-identified patent and that said Letters Patent is hereby corrected as shown below:

Column 10, claim 15, line 57, replace “polytetraethylene” with --polytetrafluorethylene--

Column 11, claim 19, line 2, replace “polytetraethylene” with --polytetrafluorethylene--

Column 5, line 26, delete “is” after the word dispersion

Signed and Sealed this

Fourteenth Day of April, 2009

JOHN DOLL
*Acting Director of the United States Patent and Trademark Office*